US008227391B2

(12) United States Patent
Ryan et al.

(10) Patent No.: US 8,227,391 B2
(45) Date of Patent: Jul. 24, 2012

(54) LUBRICATING COMPOSITION WITH GOOD OXIDATIVE STABILITY AND REDUCED DEPOSIT FORMATION

(75) Inventors: Helen T. Ryan, London (GB); Ricky Shyam Prasad, London (GB); John M. Taylor, Chesterfield, VA (US)

(73) Assignee: Afton Chemical Corporation, Richmond, VA (US)

( * ) Notice: Subject to any disclaimer, the term of this patent is extended or adjusted under 35 U.S.C. 154(b) by 45 days.

(21) Appl. No.: 12/288,222

(22) Filed: Oct. 17, 2008

(65) Prior Publication Data

US 2010/0099589 A1 Apr. 22, 2010

(51) Int. Cl.
*C10M 133/12* (2006.01)
*C10M 133/44* (2006.01)

(52) U.S. Cl. ..... 508/563; 508/279

(58) Field of Classification Search ..... 508/131, 508/279, 563

See application file for complete search history.

(56) References Cited

U.S. PATENT DOCUMENTS

| | | | | |
|---|---|---|---|---|
| 4,701,273 | A * | 10/1987 | Brady et al. | 508/281 |
| 6,180,575 | B1 * | 1/2001 | Nipe | 508/227 |
| 6,207,623 | B1 * | 3/2001 | Butler et al. | 508/273 |
| 6,410,490 | B1 | 6/2002 | Reyes-Gavilan | |
| 2006/0069000 | A1 * | 3/2006 | Dong et al. | 508/422 |
| 2009/0275491 | A1 * | 11/2009 | Komatsubara et al. | 508/192 |
| 2009/0312209 | A1 | 12/2009 | Ikai | |

FOREIGN PATENT DOCUMENTS

| | | | |
|---|---|---|---|
| EP | 1054052 | A2 | 11/2000 |
| EP | 1054052 | B1 | 11/2000 |
| WO | 2005/097728 | A1 | 10/2005 |
| WO | 2005/097729 | A1 | 10/2005 |
| WO | WO 2007052833 | A1 * | 5/2007 |
| WO | 2008/009704 | A1 | 1/2008 |

OTHER PUBLICATIONS

Notice of Reason for Rejection in Japanese Patent Application No. 99813/09 (and English translation).

* cited by examiner

*Primary Examiner* — Jim Goloboy

(57) ABSTRACT

A lubricant composition that is particularly suited for use in steam and gas turbine oils and in circulating oils has a balance of excellent oxidative stability and reduced sludge formation and comprises a blended mixture of alkylated phenyl-α-naphthylamine and at least oil soluble triazole or triazole derivative in an oil of lubricating viscosity, such compositions being capable of a residual RPVOT of 25% after at least 500 hours test duration test duration 120° C. in Dry TOST test or, alternatively 50% after 700 hours or 25% after 1000 hours.

11 Claims, 3 Drawing Sheets

LUBRICATING COMPOSITION WITH GOOD OXIDATIVE STABILITY AND REDUCED DEPOSIT FORMATION

BACKGROUND OF THE DISCLOSURE

The disclosure relates to lubricating compositions that provide good oxidative stability and reduced sludge and varnish deposits. The compositions are particularly suited for power generation devices, such as gas, steam and combined cycle turbines, as well as in other industrial fluids such as industrial gear oils, hydraulic fluids, and other circulating oils.

A turbine is a device used to generate electricity or mechanical power through rotational movement of a shaft. Gas and steam turbines use a flow of hot combustion gas or steam to generate energy in the form of thrust and/or shaft power, in any combination. For example, air flowing into the gas turbine is compressed in an air compressor and fed, at high temperature and pressure, into the combustion chamber where fuel is injected and the resulting fuel/compressed air mixture ignites. The rapidly expanding gases resulting from the ignition exit the combustion chamber at high velocity, pass over the turbine blades, and thus cause the turbine shaft to rotate. Steam and combined cycle units operate in a similar manner.

Gas, steam and combined cycle power generation units are often operated in extreme environments and exposed to changes in atmospheric pressure, changes in ambient temperature, water, sea water, dust, and a host of other liquid and solid contaminants. Sludge and other deposits are particularly undesirable in power generation units used in a peak-load or cyclic manner. In such circumstances, the turbine will be activated and put into service for relatively short periods of time to meet peak loads on the electrical grid. Once the demand softens, the units are shut down and the oil stops circulating. Sludge and other deposits are more likely to settle out of the oil composition as the oil cools down to ambient temperature. The problem is aggravated by repetition of this heating-cooling process and also probably the stagnation of the oil. Use of Group II base stocks, which have become popular in recent years, has been linked in some cases to increased sludge and varnish deposit formation. Therefore it is of benefit to reduce the formation of sludge and other deposits in turbine fluids and thus reduce the need for expensive turbine maintenance and financially detrimental system downtime. Similar concerns are present in industrial gear applications, hydraulic fluids and in other circulating oils. A number of tests are known to determine the oxidative stability of lubricating compositions. The most common are ASTM D2272—Rotary Pressure Vessel Oxidation Test ("RPVOT") and ASTM D943—Turbine Oil Stability Test ("TOST"). The fact that a particular antioxidant package performs well in these oxidative screening test, however, does not necessarily guarantee that it will be effective to control sludge and other deposits. A more stringent test is the "MHI Dry-TOST" as disclosed in Mitsubishi Heavy Industries MS04-MA-CL002, MS04-MA-CL003 and MS04-MA-CL005 (draft) specifications. This test measures both the resistance of an oil composition to oxidation and also the potential for deposit formation in the composition.

Thus, there is a need for lubricant compositions having excellent oxidative stability and minimal deposit and sludge formation.

SUMMARY OF THE DISCLOSURE

In one embodiment, the disclosure provides a lubricating composition comprising an oil of lubricating viscosity, an alkylated phenyl-α-naphthyl amine and at least one oil soluble triazole or triazole derivative, and wherein the composition is free of diphenylamine and alkylated derivatives thereof.

In one embodiment, the triazole comprises dialkylaminomethyltolytriazole.

In one embodiment, the alkylated phenyl-α-naphthyl amine comprises an alkyl group having 8-12 carbon atoms.

In one embodiment, the alkylated phenyl-α-naphthyl amine is the sole antioxidant in the concentrate.

In yet another embodiment, the composition further includes at least one additive selected from an antirust agent, a demulsifier, a diluent oil, and combinations thereof.

In an embodiment, the triazole comprises N,N-bis(2-ethylhexyl)-ar-methyl-1H-benzotriazole-1-methanamine (CAS #92470-86-7).

In some embodiments, the composition produces less than 65 mg/Kg of sludge after 500 hours test duration at 120° C. in the modified MHI Dry TOST test.

In another embodiment, the disclosure provides a method comprising the step of lubricating a turbine with a lubricant composition comprising an oil of lubricating viscosity, an alkylated phenyl-α-naphthyl amine and at least one oil soluble triazole or triazole derivative, wherein said composition is free of diphenylamine and alkylated derivatives thereof.

In some embodiments the lubricating composition comprises 0.15-0.5 wt % of alkylated phenyl-α-naphthyl amine and 0.001-0.5wt % of dialkylaminomethyltolytriazole.

In some embodiments, the alkylated phenyl-α-naphthyl amine is octylated phenyl-alpha-naphthyl amine and the dialkylaminomethyltolytriazole is N,N-bis(2-ethylhexyl)-ar-methyl-1H-benzotriazole-1-methanamine (CAS #92470-86-7).

In some embodiments, the disclosure provides a lubricating composition requiring at least 500 hours test duration at 120° C. to reach a residual RPVOT of 25% in the modified MHI Dry TOST test. In other embodiments, the lubricating composition requires at least 700 hours test duration at 120° C. to reach a residual RPVOT of 50% in the modified MHI Dry TOST test. In yet other embodiments, the composition requires at least 1000 hours test duration at 120° C. to reach a residual RPVOT of 25% in the modified MHI Dry TOST test.

In one embodiment, the disclosure provides a lubricating composition comprising an oil of lubricating viscosity and having a residual RPVOT of at least 25% after 500 hours of test duration at 120° C. In other embodiments, the composition has a residual RPVOT of at least 35% or at least 50% after 500 hours of test duration at 120° C.

It is to be understood that both the foregoing general description and the following detailed description are exemplary and explanatory only and are intended to provide further explanation of the present disclosure, as claimed.

DETAILED DESCRIPTION

Figure 1:
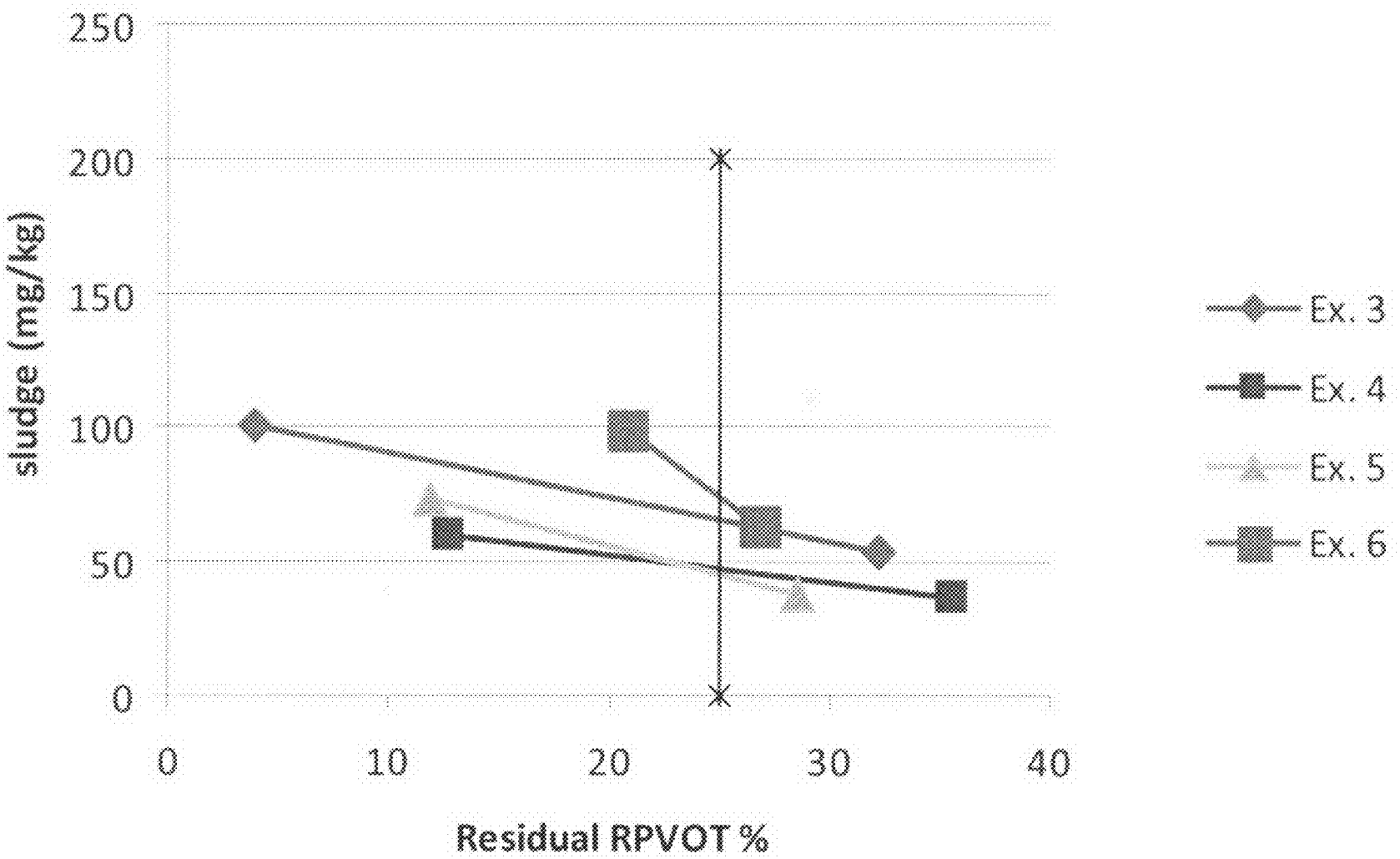
FIGS. 1-3 are graphs of sludge versus residual RPVOT in lubricating compositions of the disclosure.

The disclosure provides turbine and/or hydraulic oils having a greatly reduced tendency to form sludge and varnish deposits compared to currently available compositions, while maintaining high oxidation stability, excellent rust, demulsification and air release properties.

In the course of their investigation, the inventors discovered that an additive concentrate comprising a blended combination of an oil soluble triazole or triazole derivative such as dialkylaminomethyltolyltriazole with alkylated phenyl-α-naphthyl amine, which concentrate is free of diphenylamine and alkylated derivatives thereof, in an oil of lubricating viscosity provide good oxidative stability results in the RPVOT test and excellent sludge control results.

Conventional wisdom in the art is that oxidative stability and sludge and varnish deposit reduction can be improved by incorporating numerous antioxidants into the concentrate. For example, WO 2005/097728 teaches that a combination of alkylated phenyl-α-naphthyl amine and alkylated diphenylamine provides excellent oxidative properties to a lubricating composition. Quite unexpectedly, however, the inventors have determined that even better results are achieved using alkylated phenyl-α-naphthyl amine ("APANA") as the antioxidant when used in combination with the oil soluble triazole or derivative thereof. Indeed, the present inventors have discovered that the addition of alkylated diphenylamine actually is detrimental in the sense that it increases the amount of sludge formation without any benefit in oxidative stability. Accordingly, in particularly preferred embodiments the lubricating compositions are free of diphenylamine ("DPA") and alkylated derivatives thereof. By stating that the compositions are "free of" DPA and alkylated derivatives, we do not mean to exclude compositions that contain minor amounts of DPA or the alkylated derivatives thereof; that is, compositions containing DPA or alkylated derivatives thereof in amounts that do not appreciably increase the amount of sludge formation or otherwise negate the beneficial effects of the compositions of the present disclosure.

While not intending to be bound by any particular theory, applicants believe that the oil soluble triazole (or derivative thereof), which are corrosion inhibitors, inhibits the metal coil's catalytic effect on oil oxidation by binding to the metal surface, while the higher solubility of APANA provides excellent oxidative stability and helps reduce the formation of sludge and other deposits while providing excellent oxidative stability. APANA is a commercially available material from a variety of sources. For example, it is commercially available under the Irganox® g brand from Ciba Specialty Chemicals or the Naugalube® brand from Chemtura Petroleum Additives (such as Naugalube® APAN). The alkyl chain typically comprises 8 to 12 carbon atoms. One such example is Irganox® LO6, which is octylated phenyl-alpha-naphthyl amine.

In an embodiment, the APANA may be the sole antioxidant in the concentrate. In some embodiments, the APANA may be blended to provide a concentration of at least about 0.15 wt % based on the weight of either the concentrate or the finished lubricant. In other embodiments, the APANA may comprise about 0.3 to about 1.0 wt %, and in other embodiments may be blended to provide a concentration of about 0.3 to about 0.5 wt % based on the weight of either the concentrate or the finished lubricant composition. Below about 0.15 wt %, oxidative stability can begin to suffer, particularly in the poor-quality Group II base stocks.

Oil soluble triazoles and derivatives thereof are commercially available products that are typically used as metal deactivators and corrosion inhibitors. These materials, which are in solid or liquid form, comprise triazole and derivatives thereof, specifically including but not limited to alkylated benzotriazoles and derivatives such as tolytriazole (also known as tolutriazole or tolyltriazole); 5,5'-methylenebisbenzotriazole; 1-[di(2-ethylhexylaminomethyl)]tolutriazole; and 1-(1-cyclohexyl-oxybutyl)tolutriazole. Dialkylaminomethyltolyltriazoles are commercially available from Ciba Specialty Chemicals under the Irgamet® brand, including Irgamet® 30 which is based on alkylated triazole and Irgamet® 39, which is N,N-bis(2-ethylhexyl)-ar-methyl-1H-benzotriazole-1-methanamine (CAS #92470-86-7).

In some embodiments, the at least one triazole or derivative thereof (collectively referred to herein as a "triazole compound") is blended to provide a concentration of at least about 0.001 wt % based on the weight of either the concentrate or the finished lubricant composition. In some embodiments, the triazole compound may be blended to provide a concentration of about 0.001 to about 0.5 wt %. In another embodiment, the triazole compound may be blended to provide a concentration of about 0.01 to about 0.1 wt % based on the weight of either the concentrate or the finished lubricant composition.

In some embodiments, the finished lubricant composition further comprises at least one additive selected from antirust agents, demulsifiers, antifoam agents, dispersants, detergents, diluent oil, and combinations thereof.

Antirust agents (rust inhibitors) may be a single compound or a mixture of compounds having the property of inhibiting corrosion of ferrous metal surfaces. The rust inhibitors may be used in the range of about 0.01 wt % to about 1.0 wt % based on the total weight of the concentrate.

Demulsifiers that may be used include alkyl benzene sulfonates, polyethylene oxides, polypropylene oxides, esters of oil soluble acids and the like. The demulsifiers may be used alone or in combination. Demulsifiers may be present in a range of 0.001% to 0.01% by weight, based on the total weight of the concentrate.

In some embodiments, the additive concentrate will contain at least one diluent, most preferably an aromatic diluent. In a preferred embodiment, it is an oleaginous diluent of suitable viscosity. Such a diluent can be derived from natural or synthetic sources, or blends thereof. Among the mineral (hydrocarbonaceous) oils are paraffin base, naphthenic base, asphaltic base, and mixed base oils. Synthetic oils include polyolefin oils (especially hydrogenated alpha-olefin oligomers), alkylated aromatics, polyalkylene oxides, aromatic ethers, and carboxylate esters (especially diesters), among others. In some embodiments, the aromatic hydrocarbon oils are preferred for use as the diluent.

Typically, the diluent oil generally will have a viscosity in the range of about 1 to about 40 cSt at 100° C., and preferably about 2 to about 15 cSt at 100° C. In one particular embodiment, the diluent oil is an aromatic hydrocarbon such as Aromatic 200ND hydrocarbon fluid available from ExxonMobil Chemical Corporation.

The diluent typically is present within a broad range. In some embodiments, the diluents may be used in the range of about 0.01 wt % to about 1.0 wt % based on the total weight of the concentrate. In other embodiments, the diluents may be present in a range of from 5 wt % to 50 wt %, based on the total weight of the concentrate.

In other embodiments, the concentrate or the final lubricating composition can also comprise one or more additives that are conventionally added to lubricating compositions, such as detergents, dispersants, succinated polyolefins, viscosity modifiers, pour point depressants, antistatic agents, antifoams, extreme pressure/antiwear agents, seal swell agents, or mixtures thereof.

Defoamers suitable for use in the embodiments may include silicone oils of suitable viscosity, glycerol monostearate, polyglycol palmitate, trialkyl monothiophosphates, esters of sulfonated ricinoleic acid, benzoylacetone, methyl salicylate, glycerol monooleate, glycerol dioleate, polyacrylates, poly dimethyl siloxane, poly ethyl siloxane, polydiethyl siloxane, polymethacrylates, trimethyl-triflouro-propylmethyl siloxane and the like. The antifoams may be used alone or in combination. The antifoams may be used in the range of about 0.001 wt % to about 0.07 wt % based on the total weight of the concentrate.

The viscosity modifier provides viscosity improving properties. Examples of viscosity modifiers include vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers.

The dispersant can include one or more ashless type dispersants such as Mannich dispersants; polymeric dispersants; carboxylic dispersants; amine dispersants, high molecular weight (i.e., at least 12 carbon atoms) esters and the like; esterfied maleic anhydride styrene copolymers; maleated ethylene diene monomer copolymers; surfactants; emulsifiers; functionalized derivatives of each component listed herein and the like; and combinations and mixtures thereof. The dispersant may be used alone or in combination. In one embodiment the preferred dispersant is polyisobutenyl succinimide dispersant.

The anti-wear agents include sulfur or chlorosulfur compounds, a chlorinated hydrocarbon compound, a phosphorus compound, or mixtures thereof Examples of such agents are amine salts of phosphorus acid, reaction products of alkenes or alkenoic acids with thiophosphoric acids, chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof.

In one embodiment the antiwear agent comprises an amine salt of a phosphorus ester acid. The amine salt of a phosphorus ester acid includes phosphoric acid esters and salts thereof; dialkyldithiophosphoric acid esters and salts thereof; phosphites; and phosphorus-containing carboxylic esters, ethers, and amides; and mixtures thereof. In one embodiment the phosphorus compound further comprises a sulfur atom in the molecule. In one embodiment the amine salt of the phosphorus compound is ashless, i.e., metal-free (prior to being mixed with other components).

The antiwear agent can be used alone or in combination and may be present in an amount of 0.001 wt % to 0.5 wt %, based on the total weight of the concentrate.

The pour point depressants include alkylphenols and derivatives thereof, ethylene vinyl acetate copolymers and the like. The pour point depressant may be used alone or in combination. The pour point depressant may be present in an amount of 0.01 wt % to 0.5 wt %, based on the total weight of the concentrate.

The seal swell agents include organo sulfur compounds such as thiophene, 3-(decyloxy)tetrahydro-1,1-dioxide, phthalates and the like. The seal swell agents may be used alone or in combination. The seal swell agents may be present in an amount of 0.01 wt % to 0.5 wt %, based on the total weight of the concentrate.

The concentrate may be used as is, or may in some embodiments be added to at least one oil of a lubricating viscosity to produce a lubricating oil composition or hydraulic fluid composition. In some embodiments, the concentrate may be used in the final composition at a treat rate of 0.05 wt % to 90 wt % to provide the finished composition. The finished lubricant is prepared by mixing or blending the concentrate, and any optional additives, with a suitable base oil of a lubricating viscosity. Preferably, all the additives except for the viscosity modifier and the pour point depressant are blended into a concentrate or additive package, which is subsequently blended into base stock to make finished lubricant. Use of such concentrates is this manner is conventional. The concentrate will typically be formulated to contain the additive(s) in proper amounts to provide the desired concentration in the final formulation when the concentrate is combined with a predetermined amount of base lubricant.

The base oils, also referred to as base stocks, may comprise any of the conventional oils encompassed by API Groups I-V. In some embodiments, the base oils of API Groups II and III are preferred. The base stocks in Group I contain less than 90% saturates and/or have a sulfur content greater than 0.03%, and have a viscosity index of at least 80, but less than 120. The base stocks in Group II have at least 90% saturates, no more than 0.03% sulfur, and a viscosity index of at least 80, but less than 120. Group III base stocks have similar characteristics to Group II base stocks, except that Group III base stocks have higher viscosity indexes (i.e., a viscosity index>120). Group III base stocks are produced by further hydrocracking of Group II base stocks, or of hydroisomerized slack wax, (a byproduct of the dewaxing process). Base stocks in Group I do not give particularly good results and thus are not preferred for use as the sole base stock. However, Group I base stocks may be acceptable if mixed with base stocks from other Groups.

In one embodiment, mineral oil base stocks are used such as for example conventional and solvent-refined paraffinic neutrals and bright stocks, hydrotreated paraffinic neutrals and bright stocks, naphthenic oils, cylinder oils, and so forth, including straight run and blended oils. In one more particular embodiment, synthetic base stocks can be used such as, for example, blends of poly alpha-olefins with synthetic diesters in weight proportions (poly alpha-olefin:ester) ranging from about 95:5 to about 50:50.

Base stock oils may be made using a variety of different processes including but not limited to distillation, solvent refining, hydrogen processing, oligomerisation, esterification, and re-refining. For instance, poly alpha-olefins include hydrogenated oligomers of an alpha-olefin, the most important methods of oligomerisation being free radical processes, Ziegler catalysis, and cationic, Friedel-Crafts catalysis.

Certain examples of these types of base oils may be used for the specific properties they possess such as biodegradability, high temperature stability, or non-flammability. In other compositions, other types of base oils may be preferred for reasons of availability or lower cost. Thus, the skilled artisan will recognize that while various types of base oils discussed above may be used in the lubricant compositions, they are not necessarily equivalents of each other in every application.

EXAMPLES

A series of lubricating oil compositions were prepared for testing using the components in Table 1 as the concentrate, which was combined with a Group II base oil. Formulations are provided in Table 2 where components are listed in percent by weight. All formulations further contained 0.05-0.1 wt % of a conventional rust inhibitor.

TABLE 1

| COMPONENT | DESCRIPTION |
|---|---|
| A | Phenolic ester antioxidant |
| B | APANA antioxidant |
| C | Alkylated diphenylamine antioxidant |
| D | Liquid tolutriazole derivative (Irgamet ® 39) |
| E | Rust inhibitor |
| F | Demulsifier |
| G | Diluent oil |
| H | Group II base stock (either Higher Oxidation Stability HOS or Lower Oxidation Stability LOS) |

TABLE 2

| EXAMPLE | A | B | C | D | E | F | G | H |
|---|---|---|---|---|---|---|---|---|
| 1 | | 0.16 | 0.03 | 0.04 | 0.05-0.1 | 0.0050 | 0.05 | LOS |
| 2 | 0.01 | 0.16 | | 0.04 | 0.05-0.1 | 0.005 | 0.05 | LOS |
| 3 | | 0.19 | | 0.04 | 0.05-0.1 | 0.0050 | 0.1 | LOS |
| 4 | | 0.21 | | 0.04 | 0.05-0.1 | 0.0050 | 0.3 | LOS |
| 5 | | 0.21 | 0.1 | 0.04 | 0.05-0.1 | 0.0050 | 0.3 | LOS |
| 6 | | 0.21 | 0.2 | 0.04 | 0.05-0.1 | 0.0050 | 0.3 | LOS |
| 7 | | 0.26 | | 0.04 | 0.05-0.1 | 0.0050 | 0.3 | LOS |
| 8 | | 0.26 | 0.1 | 0.04 | 0.05-0.1 | 0.0050 | 0.3 | LOS |
| 9 | | 0.26 | 0.1 | 0.04 | 0.05-0.1 | 0.0050 | 0.3 | LOS |
| 10 | | 0.3 | | 0.06 | 0.05-0.1 | 0.0050 | 0.6 | LOS |
| 11 | | 0.5 | | 0.06 | 0.05-0.1 | 0.0050 | 0.6 | LOS |
| 12 | | 0.3 | | 0.1 | 0.05-0.1 | 0.0050 | 0.6 | LOS |
| 13 | | 0.5 | | 0.1 | 0.05-0.1 | 0.0050 | 0.6 | LOS |
| 14 | | 0.26 | | 0.04 | 0.05-0.1 | 0.005 | 0.4 | HOS |
| 15 | | 0.26 | | 0.01 | 0.05-0.1 | 0.005 | 0.4 | HOS |
| 16 | | 0.26 | | 0 | 0.05-0.1 | 0.005 | 0.4 | HOS |

The example compositions were subjected to several tests, including the Rotary Pressure Vessel Oxidation Test (RPVOT) in accordance with ASTM D2272 and a modified MHI Dry TOST test. The modified MHI Dry TOST Test generally followed the test specified in MS04-MA-CL002, except that instead of running several tubes for multiple duration times, a single specimen tube was use for each test duration. Results are reported in Table 3. For comparison, a commercially available turbine oil was also tested and is reported in Table 3 as Example C1.

TABLE 3

| | MHI Dry TOST @ 120° C. | | | | | |
|---|---|---|---|---|---|---|
| | 500 hrs | | 700 hrs | | 800 hrs | |
| Ex. | sludge (mg/kg) | % RPVOT | sludge (mg/kg) | % RPVOT | sludge (mg/kg) | % RPVOT |
| 1 | 55.2 | 25.3 | N/A[1] | 1.20 | | |
| 2 | 46.6 | 16.2 | N/A[1] | 1.70 | | |
| 3 | 54.4 | 32.2 | 101 | 3.90 | | |
| 4 | 36.8 | 35.6 | 59.8 | 12.8 | | |
| 5 | 38 | 28.5 | 74 | 11.9 | | |
| 6 | 63.2 | 26.8 | 99.4 | 20.8 | | |
| 7 | 31.4 | 47.9 | 68.1 | 19.6 | | |
| 8 | 45.1 | 39.1 | 63.1 | 20.1 | | |
| 9 | 51.5 | 40.5 | 76.6 | 19.5 | | |
| 10 | 46.9 | 60.2 | | | 87.2 | 28.8 |
| 11 | 76.4 | 62.2 | | | 96.5 | 45.1 |
| 12 | 52.2 | 53.8 | | | 126.3 | 28.7 |
| 13 | 73.9 | 66.9 | | | 96.4 | 43.1 |
| 14 | 32.0 | 79.4 | | | | |
| 15 | 43.0 | 50.2 | | | | |
| 16 | 65.0 | 40.6 | | | | |
| C1 | 66.5 | 22.2 | 184 | 2.2 | | |

Note 1:
Too much sludge to measure

As can be seen from Table 3, Examples 10-13 demonstrate a significantly improved stability and low sludge production. Specifically, at 800 hours, Examples 10-13 still had at least 28% of their initial RPVOT values. With regard to the MHI Dry TOST test, to pass the test, an oil must have a residual RPVOT of at least 25% after 500 hours of test duration at 120° C. In addition, the amount of sludge at the 25% residual RPVOT level must be less than 100 mg/Kg. In most instances, the amount of sludge at 25% RPVOT will be determined by interpolation. Interestingly, Table 3 indicates that when APANA is used at levels of 0.2-0.3 wt % in the finished fluid, and the triazole compound is used at levels of 0.04 (i.e., Examples 4-9), the oil shows very good performance in the MHI Dry TOST test. When the APANA levels are increased to 0.3-0.5 wt % and the triazole derivative is increased to 0.06-0.1 wt % (Examples 10-13), however, while the useful life of the oil (measured by residual RPVOT) were significantly improved, the sludge levels were also increased.

Figure 2:
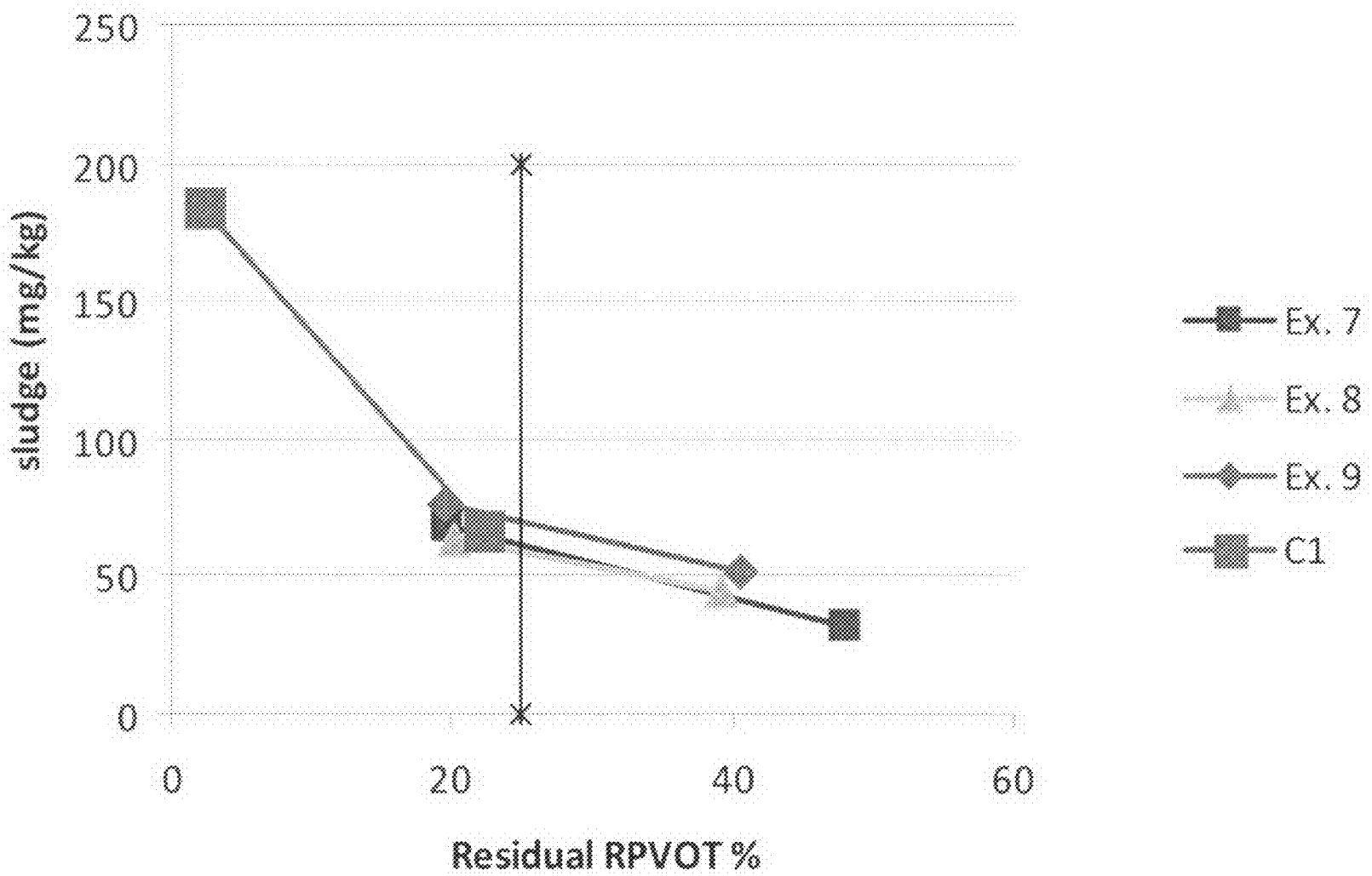
Figure 3:
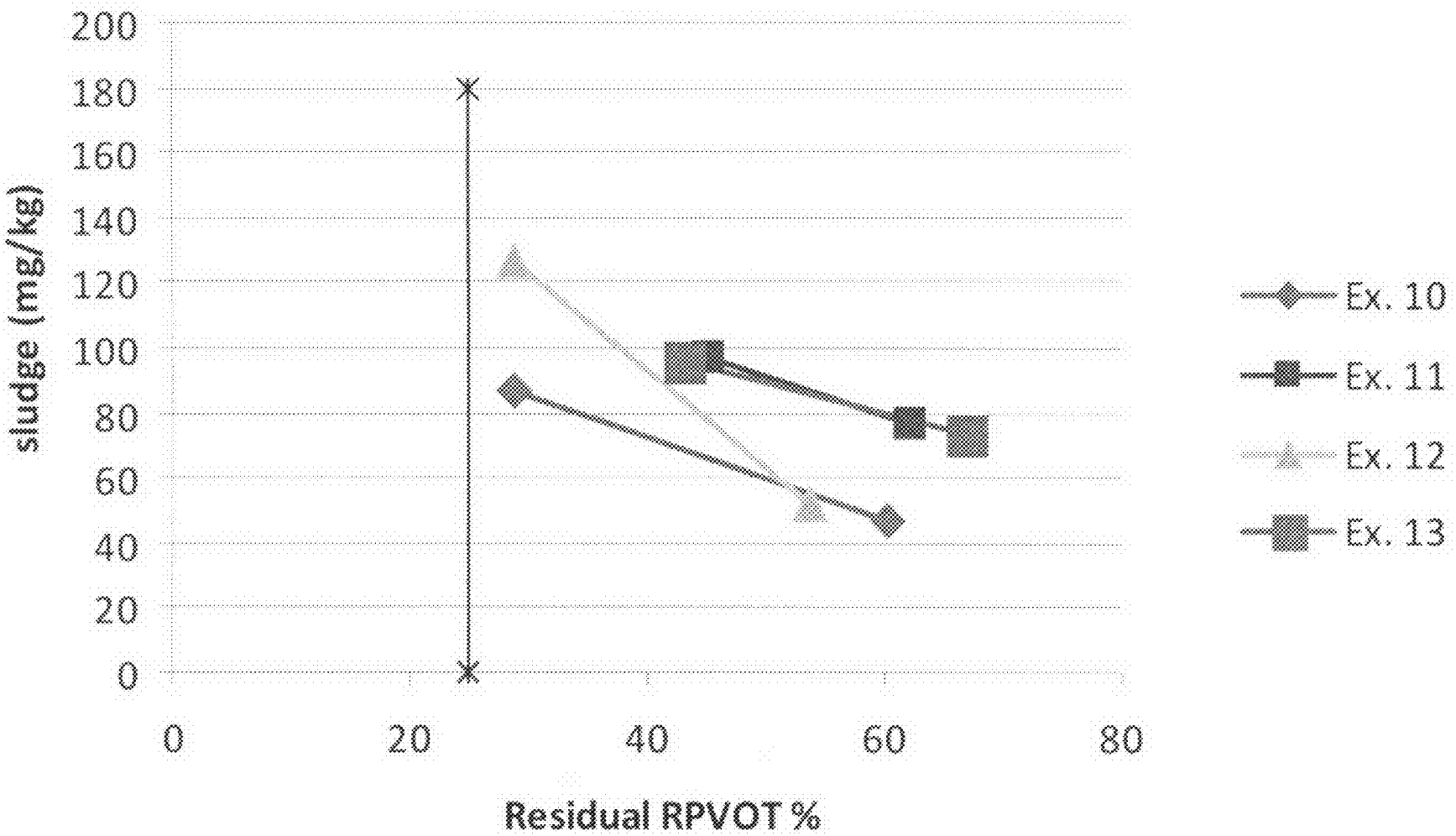

With reference to FIGS. 1-2, it can be seen that Examples 3-9 have less than 100 mg/Kg of sludge at 25% RPVOT and (from Table 3) have greater than 25% RPVOT at 500 hours and therefore pass the requirements of the MHI Dry TOST Test. With regard to Examples 10-13, even though they have greater than 25% RPVOT at 500 hours, it can be determined from FIG. 3 that at 25% RPVOT, these examples would have more than 100 mg/Kg of sludge. Examples 14-16 demonstrate the effect of reducing the level of the liquid triazole level on the sludge after 500 h in the MHI Dry TOST test. Thus, sludge levels are increased and residual RPVOT is decreased when the triazole compound level is reduced from 0.04 wt % (Example 14) to 0.01 wt % (Example 15). The effects on both sludge and residual RPVOT are more pronounced when the liquid tolutriazole derivative is absent (Example 16).

The data in Table 3 also indicate that best results are obtained when APANA is used as the only antioxidant. For example, a comparison of Example 4 versus 5 and 6 demonstrates that Example 4 (containing APANA as the only antioxidant) showed less sludge and greater residual RPVOT. Similar results are seen in comparison of Example 7 with Examples 8 and 9.

The oil composition of Example 4 is added to a gas turbine and the turbine is operated for 50 cycles of 10 hours per cycle, for a total of 500 hours operating time. The in-service oil has at least 25% residual RPVOT and less than 70 mg/Kg of sludge after 500 hours of operation.

What we claim is:

1. A composition consisting essentially of an oil of lubricating viscosity selected from API Group II, III and IV base stocks, an alkylated phenyl-α-naphthyl amine as the sole antioxidant, said alkylated phenyl-α-naphthyl amine having an alkyl group having from 8 to 12 carbon atoms and being present in an amount of 0.19-0.26 wt %; and 0.01-0.04 wt % of dimethylaminomethyltolytriazole as the sole metal deactivator, wherein said composition is free of diphenylamine and alkylated derivatives thereof.

2. The composition of claim 1, having a residual RPVOT of 25% after at least 500 hours test duration at 120° C. in the modified MHI Dry TOST test.

3. The composition of claim 1, further comprising an additive selected from an antirust agent, a demulsifier, a diluent oil, and combinations thereof.

4. The composition of claim 1 having less than 65 mg/Kg of sludge after 500 hours test duration at 120° C. in the modified MHI Dry TOST test.

5. The composition of claim 1 having a residual RPVOT of at least 25% after 800 hours test duration at 120° C. in the modified MHI Dry TOST test.

6. A method of lubricating a turbine, comprising the step of lubricating a turbine with a lubricant composition consisting essentially of an oil of lubricating viscosity selected from API Group II, III and IV base stocks, an alkylated phenyl-α-naphthylamine as the sole antioxidant, said alkylated phenyl-α-naphthyl amine having an alkyl group having from 8 to 12 carbon atoms and being present in an amount of 0.19-0.26 wt %; and 0.01-0.04 wt % of dimethylaminomethyltolytriazole as the sole metal deactivator, wherein said composition is free of diphenylamine and alkylated derivatives thereof

7. The method of claim 6, wherein said alkylated phenyl-α-naphthyl amine is octylated phenyl-alpha-naphthylamine.

8. The lubricating composition of claim 1, said composition requiring at least 500 hours test duration at 120° C. to reach a residual RPVOT of 25% in the modified MHI Dry TOST test.

9. The lubricating composition of claim 1, said composition requiring at least 700 hours test duration at 120° C. to reach a residual RPVOT of 50% in the modified MHI Dry TOST test.

10. The lubricating composition of claim 1, said composition requiring at least 1000 hours test duration at 120° C. to reach a residual RPVOT of 25% in the modified MHI Dry TOST test.

11. A lubricating composition consisting of:

a) an oil of lubricating viscosity and selected from API Groups II, III, and IV;

b) 0.19-0.26 wt % of an alkylated phenyl-α-naphthylamine as the sole antioxidant, said alkylated phenyl-α-naphthyl amine having an alkyl group having from 8 to 12 carbon atoms;

c) 0.01-0.04 wt % of dimethylaminomethyltolytriazole as the sole metal deactivator; and d) at least one additive selected from rust inhibitors, demulsifiers, antifoam agents, dispersants, detergents, diluent oil, succinated polyolefins, viscosity modifiers, pour point depressants, antistatic agents, antirust agents, extreme pressure/antiwear agents, and seal swell agents.

* * * * *